US009725792B2

(12) United States Patent
Park et al.

(10) Patent No.: US 9,725,792 B2
(45) Date of Patent: Aug. 8, 2017

(54) HIGH ELASTICITY HYPER EUTECTIC ALUMINUM ALLOY AND METHOD FOR MANUFACTURING THE SAME

(71) Applicant: Hyundai Motor Company, Seoul (KR)

(72) Inventors: Hoon Mo Park, Gyeonggi-Do (KR); Tae Gyu Lee, Seoul (KR)

(73) Assignee: Hyundai Motor Company, Seoul (KR)

( * ) Notice: Subject to any disclaimer, the term of this patent is extended or adjusted under 35 U.S.C. 154(b) by 193 days.

(21) Appl. No.: 14/471,645

(22) Filed: Aug. 28, 2014

(65) Prior Publication Data

US 2015/0292064 A1 Oct. 15, 2015

(30) Foreign Application Priority Data

Apr. 15, 2014 (KR) ..... 10-2014-0045062

(51) Int. Cl.

| | |
|---|---|
| ***C22C 1/02*** | (2006.01) |
| ***C22C 21/04*** | (2006.01) |
| ***C22C 21/02*** | (2006.01) |
| ***C22C 1/03*** | (2006.01) |
| ***C22C 1/10*** | (2006.01) |
| ***C22C 32/00*** | (2006.01) |

(52) U.S. Cl.

CPC ..... *C22C 21/04* (2013.01); *C22C 1/026* (2013.01); *C22C 1/03* (2013.01); *C22C 1/1068* (2013.01); *C22C 21/02* (2013.01); *C22C 32/0073* (2013.01)

(58) Field of Classification Search

CPC ..... C22C 21/02; C22C 21/04; C22C 1/023; C22C 1/03

USPC ..... 420/535, 537, 548, 549, 552

See application file for complete search history.

(56) References Cited

FOREIGN PATENT DOCUMENTS

| | | | | |
|---|---|---|---|---|
| JP | 04202737 | A | * | 7/1992 |
| JP | H11293374 | A | | 10/1999 |
| JP | 2001-020047 | A | | 1/2001 |
| JP | 2002-126850 | A | | 5/2002 |
| JP | 2004-523357 | A | | 8/2004 |
| JP | 2009-515041 | A | | 4/2009 |
| KR | 10-2013-0058997 | | | 6/2013 |
| KR | 10-2013-0058998 | A | | 6/2013 |
| KR | 10-2014-0021396 | A | | 2/2014 |
| KR | 10-2015-0101552 | A | | 9/2015 |

OTHER PUBLICATIONS

Al (Aluminum) Binary Alloy Phase Diagrams, Alloy Phase Diagrams, vol. 3, ASM Handbook, ASM Internatinal, 1992, p. 2.4-2.56, 2.8-9.8.*

* cited by examiner

*Primary Examiner* — Roy King
*Assistant Examiner* — Janelle Morillo
(74) *Attorney, Agent, or Firm* — Mintz Levin Cohn Ferris Glovsky and Popeo, P.C.; Peter F. Corless

(57) ABSTRACT

Disclosed herein is a high-elasticity hypereutectic aluminum alloy, including: titanium (Ti) and boron (B), wherein a composition ratio of Ti: B is 3.5 to 5:1, boron (B) is included in an amount of 0.5 to 2 wt %, and both $Al_3Ti$ and $TiB_2$ are included as reinforcing agents.

7 Claims, No Drawings

HIGH ELASTICITY HYPER EUTECTIC ALUMINUM ALLOY AND METHOD FOR MANUFACTURING THE SAME

CROSS REFERENCE TO RELATED APPLICATION

The present application claims under 35 U.S.C. §119(a) priority to Korean Patent Application No. 10-2014-0045062, filed on Apr. 15, 2014, the entire contents of which is incorporated herein for all purposes by this reference.

TECHNICAL FIELD

The present invention relates to a high-elasticity hypereutectic aluminum alloy which may have improved elasticity due to both $Al_3Ti$ and $TiB_2$ as reinforcing agents, and which may be casted by general casting or by continuous casting. In addition, a method of manufacturing the high-elasticity hypereutectic aluminum alloy is provided.

BACKGROUND

The present invention pertains to a high-elasticity aluminum material which may have improved strength and noise, vibration, and harshness (NVH) characteristics.

A conventional aluminum alloy has been manufactured by forming a reinforcing agent, such as a metal compound, carbon nanotube (CNT) and the like, which may be in the form of powder. However, price competitiveness may be reduced. Further, when a reinforcing agent is applied in the form of powder in an alloy casting process, wettability and dispersibility with aluminum (Al) matrix may be reduced. In particular, a hypereutectic aluminum casting material may be problematic in that its manufacturing process is limited to a low-pressure casting process and its processing is difficult due to the presence of coarse Si particles. In order to overcome these problems, workability and moldability of the hypereutectic aluminum casting material may be improved by increasing cooling rate and making a reinforcing agent fine.

Therefore, in order to accomplish the maximum elastic modulus and assure reproducibility, a high-elasticity material may be optimized by forming titanium compounds, such as $Al_3Ti$ and $TiB_2$ as reinforcing agents, and contribute greatly to the improvement of elasticity. Further, the high elastic material having such uniform reinforcing agents may be applied to a general casting process including high-pressure casting.

It is to be understood that the foregoing description is provided to merely aid the understanding of the present invention, and does not mean that the present invention falls under the purview of the related art which was already known to those skilled in the art.

SUMMARY OF THE INVENTION

The present invention may provide a technical solution to the above-mentioned problems, and provide a high-elasticity hypereutectic aluminum alloy. The elasticity of a novel high-elasticity hypereutectic aluminum alloy in the present invention may be remarkably improved due to both $Al_3Ti$ and $TiB_2$ which may be included in the high-elasticity hypereutectic aluminum alloy as reinforcing agents. Further, the high-elasticity hypereutectic aluminum alloy may be casted by general casting as well as by continuous casting.

In addition, a method of manufacturing the high-elasticity hypereutectic aluminum alloy is provided in the present invention.

In one aspect, a novel high-elasticity hypereutectic aluminum alloy is provided. In an exemplary embodiment, the high-elasticity hypereutectic aluminum alloy may include: titanium (Ti) and boron (B). The high-elasticity hypereutectic aluminum alloy may have a composition ratio of Ti:B may be between about 3.5:1 and about 5:1 and boron (B) may be included in an amount of about 0.5 to 2 wt %. In particular, both $Al_3Ti$ and $TiB_2$ may be included as reinforcing agents.

It is understood that weight percents of alloy components as disclosed herein are based on total weight of the alloy, unless otherwise indicated. In an exemplary embodiment, the high-elasticity hypereutectic aluminum alloy may include: copper (Cu) in an amount of about 4.5 wt %, magnesium (Mg) in an amount of about 0.60 wt %, silicon (Si) in an amount of 17 to 19 wt %, zinc (Zn) in an amount of about 0.50 wt %, boron (B) in an amount of about 0.5 to 2 wt %, titanium (Ti) in an amount of about 4 to 6 wt %, and a balance of aluminum (Al). In particular, a composition ratio of Ti:B may be between about 3.5:1 and about 5:1 and both $Al_3Ti$ and $TiB_2$ may be included as reinforcing agents.

The invention also provides the above alloys that consist essentially of, or consist of, the disclosed materials. For example, a high-elasticity hypereutectic aluminum alloy is provided that consists essentially of, or consists of: copper (Cu) in an amount of about 4.5 wt %, magnesium (Mg) in an amount of about 0.60 wt %, silicon (Si) in an amount of about 17 to 19 wt %, zinc (Zn) in an amount of about 0.50 wt %, boron (B) in an amount of about 0.5 to 2 wt %, titanium (Ti) in an amount of about 4 to 6 wt %, and a balance of aluminum (Al). In particular, a composition ratio of Ti:B may be between about 3.5:1 and about 5:1 and both $Al_3Ti$ and $TiB_2$ may be included as reinforcing agents.

In another aspect, the present invention provides a method of manufacturing a high-elasticity hypereutectic aluminum alloy. In an exemplary embodiment, the method may include steps of: introducing Al and an Al—B master alloy, and an Al—Ti master alloy or a Ti material into a melting furnace; first stirring the molten metal to promote a reaction; introducing an additive; and second stirring the molten metal. In the introducing Al and Al—B master alloy, a composition ratio of Ti:B may be between about 3.5:1 and about 5:1 and B is included in an amount of 0.5 to 2 wt %, thereby preparing a molten metal. In the first stirring, both $Al_3Ti$ and $TiB_2$ may be formed as reinforcing agents. In the second stirring, the formed reinforcing agents may be uniformly dispersed in the molten metal. In particular the Al—B master alloy may include: boron (B) in an amount of about 3 to 8 wt %, and a balance of Al, and the Al—Ti master alloy may include titanium (Ti) in an amount of about 5 to 10 wt %, and a balance of Al.

Further provided are vehicles and vehicle parts that comprise one or more of the alloys disclosed herein. Preferred is a vehicle part that comprises an alloy as disclosed herein.

Other aspects of the invention are disclosed infra.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Hereinafter, various exemplary embodiments of the present invention will be described in detail but not limited thereto.

The present invention pertains to a high-elasticity hypereutectic aluminum alloy. The high-elasticity hypereutectic aluminum alloy may have improved elasticity due to both $Al_3Ti$ and $TiB_2$ as reinforcing agents, and may be casted by general casting as well as by continuous casting due to substantially low process temperature or crystallization temperature of primary silicon (Si).

The high-elasticity hypereutectic aluminum alloy according to an exemplary embodiment of the present invention may include: titanium (Ti) and boron (B). The high-elasticity hypereutectic aluminum alloy may have a composition ratio of Ti:B between about 3.5:1 and about 5:1, and boron (B) may be included in an amount of about 0.5 to 2 wt %. In particular, both $Al_3Ti$ and $TiB_2$ may be included as reinforcing agents.

An aluminum alloy in the related art, as a hypereutectic aluminum alloy, the content of silicon (Si) may be restricted to in a range of about 17 to 19 wt %, the content of boron (B) may be set in a range of about 0.5 to 2 wt % in order to maximize the formation of titanium compounds, for example, $TiB_2$ (570 GPa) or $Al_3Ti$ (220 GPa), which may be most effective in improving elasticity. Further, the composition ratio of Ti:B may be set in a range between about 3.5 to about 5:1 as of a basic alloy system.

Silicon (Si), as used herein, as a main element of aluminum alloy for casting may have a great effect on fluidity and casting quality, and improve elasticity. However, when silicon (Si) is added in an amount of 19 wt % or greater, primary Si particles may be formed, and thus the microstructure of an aluminum alloy may be non-uniform, and the workability thereof may deteriorate. In an exemplary embodiment of the present invention, an aluminum alloy including a substantial amount of Si needs a continuous casting process instead of general casting process, and a post-molding process. In an exemplary embodiment of the present invention, for the purpose of obtaining an aluminum alloy having a uniform and fine structure even at the time of applying a general casting process, such as gravity casting, low-pressure casting or the like, the content of Si in the alloy system may be in an amount of 17 to 19 wt %.

Ti and B may be the most important elements in the hypereutectic aluminum alloy according to an exemplary embodiment, because $TiB_2$ and $Al_3Ti$, as reinforcing agents, may be formed when Ti and B are added to aluminum. Particularly, when the composition ratio of Ti:B is about 3.5:1 or less, $TiB_2$ may be formed substantially without $Al_3Ti$, and thus the improvement of elasticity may be insufficient. Further, when the composition ratio of Ti:B is about 6:1 or greater, the melting point of the aluminum alloy may increase to about 800° C. or greater, and thus substantially large amount of oxide inclusion may be generated in molten metal, and the concentration of gas in the molten metal may increase, thereby causing a negative effect on the inner quality of a cast product.

Further, the content of B may be at least of about 0.5 wt % in order to form a minimum amount of $TiB_2$, and may be less than about 2 wt % due to the increase of dissolution temperature, the control of inclusion and the increase in cost of a raw material. Accordingly, to form both $Al_3Ti$ and $TiB_2$, Ti and B may be included with the composition ratio of Ti:B between about 3.5:1 and 5:1.

In an exemplary embodiment, the hypereutectic aluminum alloy may include: copper (Cu) in an amount of about 4.0 to 5.0 wt %, magnesium (Mg) in an amount of about 0.45 to 0.65 wt %, manganese in an amount of about 0.1 wt %, silicon (Si) in an amount of 17 to 19 wt %, zinc (Zn) in an amount of about 0.10 wt %, and a balance of aluminum (Al), thereby obtaining both elasticity and castability. The hypereutectic aluminum alloy may further comprise B in an amount of about 0.5 to 2 wt % and titanium in an amount of about 4 to 6 wt %. In particular, the composition ratio of Ti:B may be in a range between about 3.5:1 and 5:1.

In an exemplary embodiment, the aluminum alloy of the present invention basically may include copper (Cu) in an amount of about 4.0 to 5.0 wt %, magnesium (Mg) in an amount of about 0.45 to 0.65 wt %, manganese in an amount of about 0.1 wt %, silicon (Si) in an amount of 17 to 19 wt %, zinc (Zn) in an amount of about 0.10 wt %, and a balance of aluminum, wherein the content of B may be in an amount of about 0.5 to 2 wt %, and the content of Ti may be adjusted such that the composition ratio of Ti:B in a range between about 3.5:1 and about 5:1. In addition, other alloy elements, such as Si, Cu, Mg and the like, may be included at the same composition ratio as that of the aluminum alloy A390. Accordingly, the aluminum alloy of the present invention may include both $Al_3Ti$ and $TiB_2$ as reinforcing agents.

In Table 1, provided are the compositions of exemplary Al—Si—Ti—B alloys according to an exemplary embodiment of the present invention.

TABLE 1

| | | Si | Fe | Cu | Mn | Mg | Zn | Ti | B | Al |
|---|---|---|---|---|---|---|---|---|---|---|
| Conventional commercially available alloy | A390 | 17 to 19 | 0.5 | 4.0 to 5.0 | 0.1 | 0.45 to 0.65 | 0.1 | 0.2 | — | balance |
| Invention | EXAMPLE 1 | 14 to 20 | — | — | — | — | — | 4 to 6 | 1 to 2 | balance. |
| | EXAMPLE 2 | 17 to 19 | 0.5 | 4.0 to 5.0 | 0.1 | 0.45 to 0.65 | 0.1 | 4 to 6 | 1 to 2 | balance |

Provided in Table 2 are the results of evaluating the Al—Si—Ti—B alloy system of which the contents of Ti and B were adjusted and the content of Si is about 17 wt %, and the results of evaluating the Al—Si—Ti—B alloy system, of which the content of Si was changed with the composition ratio of Ti:B set to 5:1.

TABLE 2

| | | Elastic modulus (GPa) | Melting point (° C.) |
|---|---|---|---|
| None of Ti and B | Al—17Si | 78 | 645 |
| Ti/B = 1 | Al—17Si—1B—1Ti | 80 | 653 |
| Ti/B = 2.3 | Al—17Si—1B—2.3Ti | 83 | 655 |
| Ti/B = 3.5 | Al—17Si—1B—3.5Ti | 83.4 | 645 |
| Ti/B = 5 | Al—17Si—1B—5Ti | 86.7 | 627 |
| Ti/B = 6 | Al—17Si—1B—6Ti | 88.6 | 675 |
| Ti/B = 7 | Al—17Si—1B—7Ti | 90.8 | 708 |
| Ti:B = 5:1 | | | |
| None of Ti and B | Al—17Si | 78 | 645 |
| Si = 13 | Al—13Si—1B—5Ti | 83.2 | 721 |
| Si = 15 | Al—15Si—1B—5Ti | 84.8 | 680 |
| Si = 17 | Al—17Si—1B—5Ti | 86.7 | 627 |

TABLE 2-continued

| | | Elastic modulus (GPa) | Melting point (° C.) |
|---|---|---|---|
| Si = 19 | Al—19Si—1B—5Ti | 88.23 | 655 |
| Si = 21 | Al—21Si—1B—5Ti | 90 | 686 |

As shown in Table 2, in the hypereutectic aluminum alloy, Si may be solid-dispersed in $Al_3Ti$ by the addition of Ti, and thus the effect of improving elasticity may be restricted by primary Si. Therefore, controlling the composition ratio of Ti/B in order to maximize the elasticity of the hypereutectic aluminum alloy may be required to maximize the formation of a reinforcing agent. Simultaneously, Si content may be changed to consider the effect thereof the hypereutectic aluminum alloy.

Accordingly, when the composition ratio of Ti:B was set in a range between about 3.5:1 and about 5:1, and the melting point of the hypereutectic aluminum alloy was lowered, thereby improving the fluidity and castability thereof. Further, the lowering of the melting point may be advantageous in terms of the process window of Si texture control in the hypereutectic aluminum alloy.

Meanwhile, when the composition ratio of Ti:B is set in a range between about 3.5:1 and to about 5:1 and the content of Si is set in a range of about 17 to 19 wt %, the elasticity of the hypereutectic aluminum alloy of the present invention may be improved by about 11.5% or greater compared to that of a conventional aluminum alloy, and the melting point thereof may be lowered by at most 19° C., for example, from about 645 to about 627° C., compared to that of the conventional aluminum alloy. Further, reinforcing particles may be formed in addition to primary Si particles, thereby improving the wear resistance thereof. A continuous casting process, such as high dissolution temperature, or rapid cooling speed, may be applied to general hypereutectic aluminum for the purpose of the refinement and uniform dispersion of Si particles. However, in the present invention, due to the lowering of the melting point, a high-efficiency general casting process may be applied instead of a high-cost continuous casting process.

The results of evaluating the elasticity and melting point of the aluminum alloy according to various exemplary embodiments of the present invention while changing the content of Si with the composition ratio of Ti:B about 5:1 are given in Table 3 below.

TABLE 3

| (Unit: wt %) | | Al | Si | $Al_2Cu$ | $TiB_2$ | $AlB_2$ | $Al_3Ti$ | $Al_2Cu_2Mg_8Si_6$ | α | Elastic modulus (GPa) | Melting point (° C.) |
|---|---|---|---|---|---|---|---|---|---|---|---|
| Specific properties | Elastic modulus (GPa) of reinforcing agent | 66.3 | 161 | 209 | 564 | 234 | 220 | 245 | 298 | — | — |
| | Density (g/cm$_3$) | 2.7 | 2.33 | 4.22 | 4.49 | 3.16 | 3.3 | 2.76 | 3.54 | — | — |
| Commercially available material | A390 | 75.4 | 16.4 | 5.6 | — | — | — | 1.7 | 0.9 | 85 | 661 |
| Si = 13 | A390-5Ti—1B | 68.8 | 12.5 | 5.8 | 3.2 | — | 7.4 | 1.4 | 0.6 | 91.6 | 725 |
| Si = 17 | A390-5Ti—1B | 64.7 | 16.4 | 5.7 | 3.2 | — | 7.4 | 1.7 | 0.9 | 95.4 | 639 |
| Si = 19 | A390-5Ti—1B | 60.5 | 18.5 | 5.8 | 3.2 | — | 7.4 | 1.4 | 0.9 | 97.3 | 670 |

In the case of A390 alloy, the content of Ti is restricted to about 0.2 wt % or less, and B is not added. In the Examples of Table 3 above, the contents of Ti and B are adjusted, the content of Si is varied as about 13 wt %, about 17 wt % and about 19 wt %, and other elements of the alloy composition thereof are maintained as the same as a conventional A390 alloy. For example, in the case of A390-1B-5Ti, the content of B is adjusted to about 1 wt %, the content of Ti is adjusted to about 5 wt %, other added elements are maintained as the same as the conventional A390 alloy, while the content of Si is varied as about 13 wt %, about 17 wt % and about 19 wt %, and a balance of Al is included.

As shown in Table 3 above, when the composition ratio of Ti:B is about 5:1 and the content of Si is about 17 wt %, the elasticity of the hypereutectic aluminum alloy in an exemplary embodiment of the present invention may be improved by about 12.2% or greater compared to that of a conventional aluminum alloy, and the melting point thereof and the crystallization temperature of primary Si may be lowered by at most 22° C., for example, from about 661 to about 639° C., compared to that of the conventional aluminum alloy. Further, the reinforcing particles may be formed in addition to primary Si particles, thereby improving the wear resistance thereof.

In the related arts, a continuous casting process, such as high dissolution temperature and rapid cooling speed, may be applied to general hypereutectic aluminum for the purpose of the refinement and uniform dispersion of Si particles. However, according to an exemplary embodiment the present invention, due to the lowering of the melting point, a high-efficiency general casting process may be applied instead of a high-cost continuous casting process.

Meanwhile, the method of manufacturing the high-elasticity hypereutectic aluminum alloy according to an exemplary embodiment of the present invention may include steps of: introducing Al and an Al—B master alloy, and an Al—Ti master alloy or a Ti material into a melting furnace such that a composition ratio of Ti:B in a range of between about 3.5:1 and about 5:1 and B may be included in an amount of about 0.5 to 2 wt %, thereby preparing a molten metal; first stirring the molten metal to promote a reaction such that both $Al_3Ti$ and $TiB_2$ are formed as reinforcing agents; introducing an additive; and second stirring the molten metal such that the formed reinforcing agents are uniformly dispersed in the molten metal.

In particular, the Al—B master alloy may include B in an amount of about 3 to 8 wt % and a balance of Al. Further, the Al—Ti master alloy may include Ti in an amount of about 5 to 10 wt % and a balance of Al. In the case of the Ti material, a high-concentration, for example, from about 75 to about 95 wt %, Ti material containing sodium-free flux as a reaction activator or a pure (100 wt %) Ti material may be used. In an exemplary embodiment of the present invention, a Ti material having a concentration of about 75 wt % may be used.

Meanwhile, in the first and second stirring steps, stirring speed may be about 500 rpm or greater. Further, the diameter of a stirring bar may be about 40 mm or greater because the diameter thereof may have an effect on the acceleration of a reaction and the dispersion of reinforcing particles. When the stirring speed is less than about 500 rpm, deterioration of fluidity may occur due to the remaining of coarse $Al_3Ti$ particles, deterioration of elasticity may occur due to the insufficient formation of $TiB_2$ and the deviation may be caused according to the region of the molten metal.

As described above, a conventional hypereutectic aluminum alloy may cause problems in that a continuous casting process must be applied due to high-temperature dissolution and rapid cooling speed, and in that inclusions may increase and economical efficiency may decrease. However, in various exemplary embodiment of the present invention, a general casting process may be used in addition to a continuous casting process because the process temperatures, such as dissolution temperature, primary silicon (Si) crystallization temperature, and the like, in the manufacturing of the hypereutectic aluminum alloy may be lower than those of a commercially available hypereutectic aluminum alloy in the manufacturing thereof, and process may be substantially controlled although a continuous casting process is used.

Further, according to the present invention, elasticity, strength, wear resistance, workability and the like of the hypereutectic aluminum alloy may be improved by the optimization of a titanium compound by forming maximum amount of fine $TiB_2$ particles, distributing the fine $TiB_2$ particles uniformly, and forming $Al_3Ti$ particles, and the like, through the control of a composition ratio. Although the exemplary embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A high-elasticity hypereutectic aluminum alloy, comprising: copper (Cu) in an amount of about 4.5 wt %, magnesium (Mg) in an amount of about 0.60 wt %, silicon (Si) in an amount of about 17 to 19 wt %, zinc (Zn) in an amount of about 0.50 wt % boron (B) in an amount of about 0.5 to 2 wt %, titanium (Ti) in an amount of about 4 to 6 wt %, and a balance of aluminum (Al), wherein a composition ratio of Ti: B is between about 3.5 to about 5:1, and both $Al_3Ti$ and $TiB_2$ are included as reinforcing agents.

2. A high-elasticity hypereutectic aluminum alloy, essentially consisting of:

copper (Cu) in an amount of about 4.5 wt %, magnesium (Mg) in an amount of about 0.60 wt %, silicon (Si) in an amount of about 17 to 19 wt %, zinc (Zn) in an amount of about 0.50 wt %, boron (B) in an amount of about 0.5 to 2 wt %, titanium (Ti) in an amount of about 4 to 6 wt %, and a balance of aluminum (Al), wherein a composition ratio of Ti: B is between about 3.5 to about 5:1, and both $Al_3Ti$ and $TiB_2$ are included as reinforcing agents.

3. A method of manufacturing the high-elasticity hypereutectic aluminum alloy of claim 1, comprising the steps of:

introducing Al and an Al-B master alloy, and an Al-Ti master alloy or a Ti material into a melting furnace, wherein a composition ratio of Ti: B is between about 3.5 and about 5:1 and B is included in an amount of about 0.5 to 2 wt %, thereby preparing a molten metal;

first stirring the molten metal to promote a reaction, wherein both $Al_3Ti$ and $TiB_2$ are formed as reinforcing agents;

introducing an additive; and second stirring the molten metal such that the formed reinforcing agents are uniformly dispersed in the molten metal.

4. The method of claim 3, wherein the Al-B master alloy comprises an amount of about 3 to 8 wt % of B and a balance of Al.

5. The method of claim 3, wherein the Al-Ti master alloy comprises an amount of about 5 to 10 wt % of Ti and a balance of Al.

6. A vehicle part manufactured from the high-elasticity hypereutectic aluminum alloy of claim 1.

7. A vehicle part manufactured from the high-elasticity hypereutectic aluminum alloy of claim 2.

* * * * *